US011317179B2

(12) United States Patent
Yoo et al.

(10) Patent No.: US 11,317,179 B2
(45) Date of Patent: Apr. 26, 2022

(54) MEMS MICROPHONE AND METHOD OF MANUFACTURING THE SAME

(71) Applicants: HYUNDAI MOTOR COMPANY, Seoul (KR); KIA MOTORS CORPORATION, Seoul (KR)

(72) Inventors: Il Seon Yoo, Hwaseong-si (KR); Sang Hyeok Yang, Suwon-si (KR); Hyun Soo Kim, Yongin-si (KR); Dong Gu Kim, Hwaseong-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 17/069,577

(22) Filed: Oct. 13, 2020

(65) Prior Publication Data

US 2022/0046344 A1 Feb. 10, 2022

(30) Foreign Application Priority Data

Aug. 5, 2020 (KR) ..... 10-2020-0098180

(51) Int. Cl.
*H04R 19/04* (2006.01)
*H04R 1/02* (2006.01)

(52) U.S. Cl.
CPC ..... *H04R 1/02* (2013.01); *H04R 2201/003* (2013.01); *H04R 2201/029* (2013.01)

(58) Field of Classification Search
CPC combination set(s) only.
See application file for complete search history.

(56) References Cited

U.S. PATENT DOCUMENTS 10,887,714 B2 * 1/2021 Yoo ..... H04R 31/00
2015/0110309 A1 * 4/2015 Park ..... H04R 17/00 381/190

* cited by examiner

*Primary Examiner* — Amir H Etesam
(74) *Attorney, Agent, or Firm* — Morgan, Lewis & Bockius LLP

(57) ABSTRACT

A MEMS microphone and a manufacturing method thereof are provided. The MEMS microphone includes: a substrate configured to have a through portion formed in a central portion thereof; a vibration membrane configured to have an uneven structure formed on the through portion of the substrate; and a fixed membrane provided on an upper position spaced apart from the vibration membrane by a predetermined distance.

20 Claims, 20 Drawing Sheets

<Prior Art>

MEMS MICROPHONE AND METHOD OF MANUFACTURING THE SAME

CROSS-REFERENCE TO RELATED APPLICATION

This application claims priority to and benefits of Korean Patent Application No. 10-2020-0098180, filed on Aug. 5, 2020, the entire contents of which are incorporated herein by reference.

TECHNICAL FIELD

The present disclosure relates to a high-sensitive micro electro-mechanical systems (MEMS) microphone and a manufacturing method thereof.

BACKGROUND

In general, a capacitor type of microphone outputs a voice signal using capacitance generated between two electrodes facing each other. The capacitor type of microphone may be manufactured to have a very small size through a semiconductor MEMS process.

An existing structure of the MEMS microphone is formed to include an even vibration membrane and a fixed membrane as illustrated in FIG. 1, to convert a change in capacitance that is generated when sound pressure is applied to the vibration membrane and moves up and down into a voltage signal.

Most important factors that determine sensitivity of a MEMS microphone include stiffness of the vibration membrane, a gap between the vibration membrane and the fixed membrane, a bias voltage, and the like, there is a limit to a process of reducing a residual stress of the vibration membrane or reducing the gap between the vibration membrane and the fixed membrane in order to improve the sensitivity, and techniques to reduce the stiffness while structurally solving the residual stress of the vibration membrane are being actively studied.

The above information disclosed in this Background section is only for enhancement of understanding of the background of the disclosure, and therefore it may contain information that does not form the prior art that is already known in this country to a person of ordinary skill in the art.

SUMMARY

The present disclosure provides a high-sensitive MEMS microphone and a manufacturing method thereof, capable of lowering stiffness of a vibration membrane and maximizing capacitance by forming the vibration membrane to have an uneven structure, to improve sensitivity.

The technical objects of the present disclosure are not limited to the objects mentioned above, and other technical objects not mentioned can be clearly understood by those skilled in the art from the description of the claims.

An exemplary embodiment of the present disclosure provides a MEMS microphone including: a substrate configured to have a through portion formed in a central portion thereof; a vibration membrane configured to have an uneven structure formed on the through portion on the substrate; and a fixed membrane deposited on an upper position spaced apart from the vibration membrane having the uneven structure by a predetermined distance.

In an exemplary embodiment, the fixed membrane may have an air inlet with a surface vertically facing a convex portion of the uneven structure of the vibration membrane to be penetrated.

In an exemplary embodiment, the fixed membrane may be deposited on the vibration membrane having the uneven structure to be spaced apart from the uneven structure, and includes a fixed membrane electrode layer; and a fixed membrane support layer deposited on the fixed membrane electrode layer.

In an exemplary embodiment, the MEMS microphone may be further include an oxide membrane deposited on the substrate in a region that is other than the through portion of the substrate.

In an exemplary embodiment, the MEMS microphone may be further include a sacrificial layer deposited on the vibration membrane that is deposited on the oxide membrane.

In an exemplary embodiment, the fixed membrane support layer may be deposited on the sacrificial layer.

In an exemplary embodiment, the MEMS microphone may be further include a first electrode pad for supplying a voltage to the vibration membrane.

In an exemplary embodiment, the first electrode pad may be formed to contact the vibration membrane through holes that are formed by etching the sacrificial layer and the fixed membrane support layer.

In an exemplary embodiment, the MEMS microphone may be further include a second electrode pad for supplying a voltage to the fixed membrane.

In an exemplary embodiment, the first electrode pad may be formed to contact the fixed membrane through a hole that is formed by etching the sacrificial layer.

In an exemplary embodiment, the vibrating membrane may have a plurality of etching patterns having an annular structure, wherein the annular etching patterns may be formed in a direction expanding from a center of a circle to an outer direction of the circle, and each of the annular etched patterns may have a structure in which patterns having a predetermined size are spaced apart at a regular interval in a horizontal direction to be arranged in an annular structure.

In an exemplary embodiment, the vibration membrane may have an etching pattern of an annular structure, and includes a structure in which first and second patterns having different lengths that externally extend in a longitudinal direction from a center of a circle in the annular etching pattern are alternately arranged.

In an exemplary embodiment, the vibration membrane may have a plurality of etching patterns having an annular structure, wherein the annular etching patterns may be formed in a direction expanding from a center of a circle to an outer direction of the circle, and each of the annular etching patterns may include a structure in which first and second patterns having different lengths are alternately disposed in a longitudinal direction.

An exemplary embodiment of the present disclosure provides a manufacturing method of a MEMS microphone, including: depositing an oxide membrane on a substrate and patterning it to have an uneven structure; depositing a vibration membrane on the oxide membrane; depositing a sacrificial layer on the vibration membrane; depositing a fixed membrane on the sacrificial layer; etching the fixed membrane to form alternating holes therein; forming a through portion by etching a central portion of the substrate to expose the oxide membrane; and etching the sacrificial layer and the oxide membrane on the through portion;

In an exemplary embodiment, the depositing of the fixed membrane may include: depositing a fixed membrane electrode layer on the sacrificial layer; depositing a fixed membrane support layer on the fixed membrane electrode layer.

In an exemplary embodiment, the etching of the fixed membrane to form alternating holes therein may include etching the fixed membrane such that the holes and a convex portion of the uneven structure of the vibration membrane therebelow are positioned at a vertically same position.

In an exemplary embodiment, the method may further include: forming a first electrode pad that is connected to the vibration membrane; and forming a second electrode pad that is connected to the fixed membrane.

In an exemplary embodiment, the forming of the first electrode pad that is connected to the vibration membrane may include: forming an electrode hole by etching the fixed membrane and the sacrificial layer to expose the vibration membrane; and forming the first electrode pad by depositing a metal material in the electrode hole.

In an exemplary embodiment, the forming of the second electrode pad that is connected to the fixed membrane may include: forming an electrode hole by etching the fixed membrane support layer to expose the fixed membrane electrode layer; and forming the second electrode pad by depositing a metal material in the electrode hole.

In an exemplary embodiment, the depositing of the vibration membrane on the oxide membrane may include: depositing a vibration membrane on the oxide membrane; performing ion implantation into the vibration membrane; and performing annealing on the ion-implanted vibration membrane.

According to this technique, it is possible to lower stiffness of a vibrating membrane and maximize capacitance by forming the vibrating membrane in an uneven structure, to improve sensitivity through a simple etching process.

In addition, various effects that can be directly or indirectly identified through this document may be provided.

DRAWINGS

DETAILED DESCRIPTION

Figure 1:
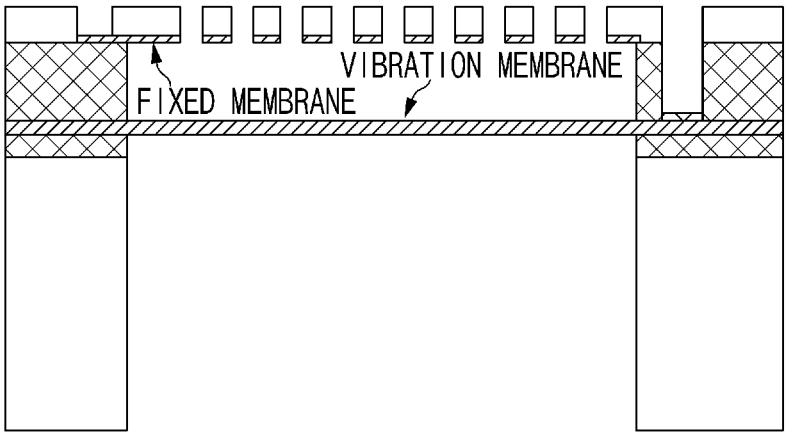
FIG. 1 illustrates a cross-sectional view of a conventional MEMS microphone.

Hereinafter, some exemplary embodiments of the present disclosure will be described in detail with reference to exemplary drawings. It should be noted that in adding reference numerals to constituent elements of each drawing, the same constituent elements have the same reference numerals as possible even though they are indicated on different drawings. In addition, in describing exemplary embodiments of the present disclosure, when it is determined that detailed descriptions of related well-known configurations or functions interfere with understanding of the exemplary embodiments of the present disclosure, the detailed descriptions thereof will be omitted.

In describing constituent elements according to an exemplary embodiment of the present disclosure, terms such as first, second, A, B, (a), and (b) may be used. These terms are only for distinguishing the constituent elements from other constituent elements, and the nature, sequences, or orders of the constituent elements are not limited by the terms. In addition, all terms used herein including technical scientific terms have the same meanings as those which are generally understood by those skilled in the technical field to which the present disclosure pertains (those skilled in the art) unless they are differently defined. Terms defined in a generally used dictionary shall be construed to have meanings matching those in the context of a related art, and shall not be construed to have idealized or excessively formal meanings unless they are clearly defined in the present specification.

The present disclosure discloses a technique capable of reducing stiffness (a rigid property that does not change shape or volume even when pressure is applied to an object) and maximizing capacitance by forming a vibration membrane of a MEMS microphone to have an uneven structure, thereby improving sensitivity.

Hereinafter, exemplary embodiments of the present disclosure will be described in detail with reference to FIG. 2 to FIG. 9.

Figure 2:
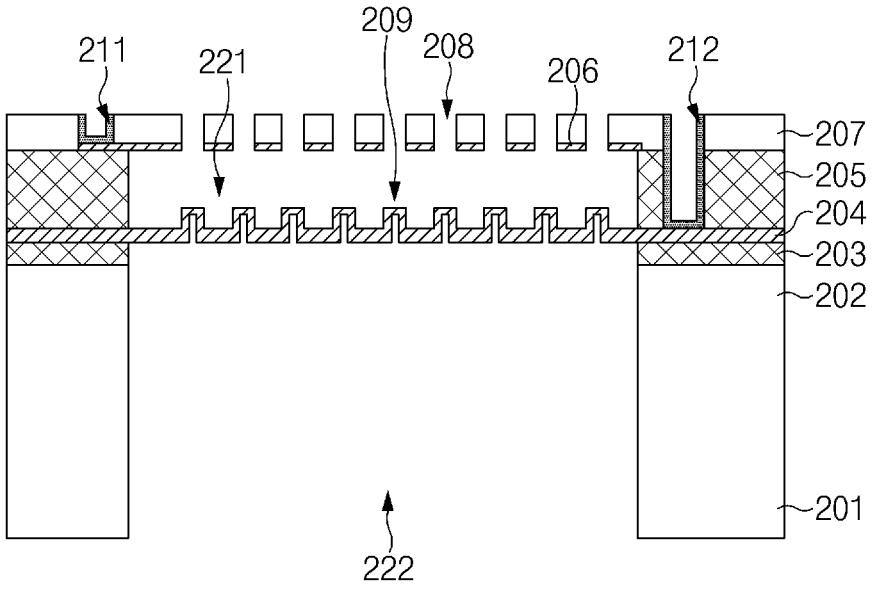
FIG. 2 illustrates cross-sectional view showing a MEMS microphone in one form of the present disclosure.
Figure 3:
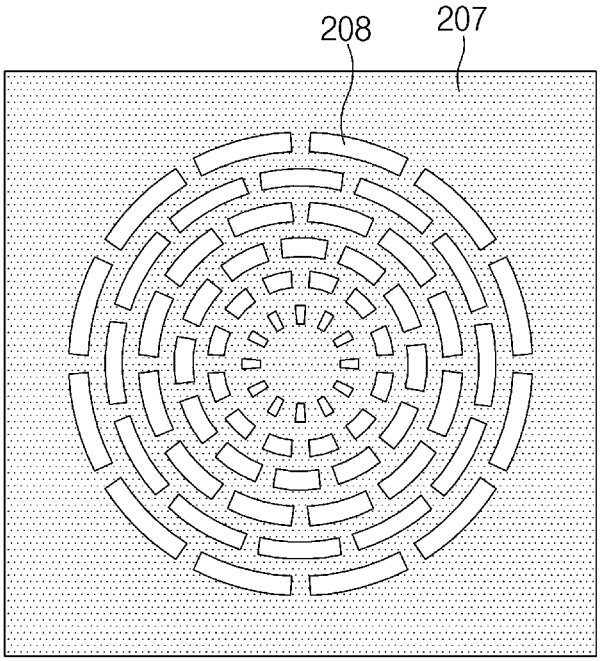
FIG. 3 illustrates a top plan view of a fixed membrane of a MEMS microphone in one form of the present disclosure.
Figure 4:
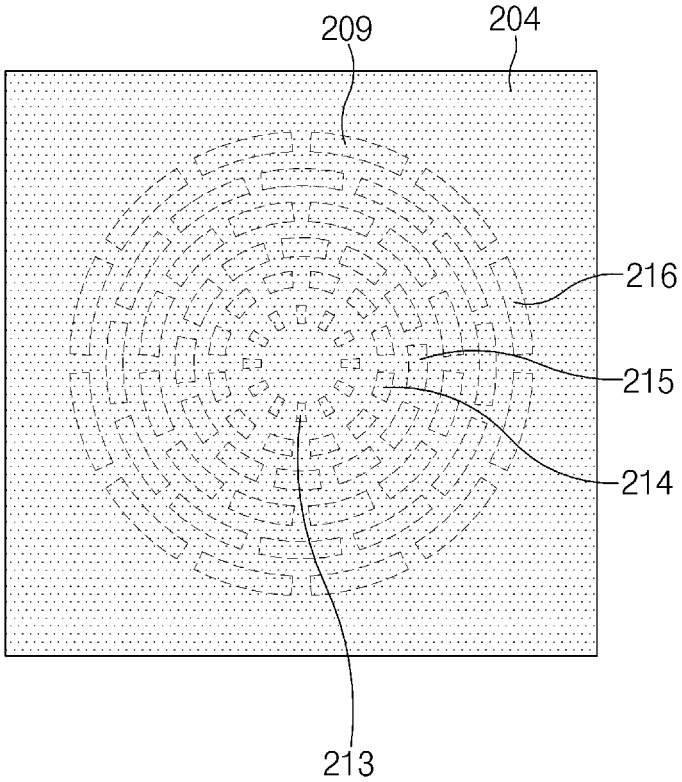
FIG. 4 illustrates a top plan view of a vibration membrane of a MEMS microphone in one form of the present disclosure.

FIG. 2 illustrates cross-sectional view showing a MEMS microphone according to an exemplary embodiment of the present disclosure, FIG. 3 illustrates a top plan view of a vibration membrane of a MEMS microphone according exemplary embodiment of the present disclosure, and FIG. 4 illustrates a top plan view of a vibration membrane of a MEMS microphone according exemplary embodiment of the present disclosure.

Referring to FIG. 2, in the MEMS microphone according to an exemplary embodiment of the present disclosure, an oxide membrane 203 is formed on a substrate 201, and a vibration membrane 204 having an uneven structure is deposited on the oxide membrane 203, and a sacrificial layer 205, a fixed membrane electrode layer 206, and a fixed membrane support layer 207 are sequentially stacked on the vibration membrane 204. In this case, the fixed membrane electrode layer 206 and the fixed membrane support layer 207 are referred to as fixed membranes.

A central portion of the substrate 201 is etched to form a through portion 221, and the vibration membrane 204 and the fixed membranes 206 and 207 are spaced apart by an air layer 222 by etching the sacrificial layer 205 on the vibration membrane 204 having the uneven structure.

The fixed membranes 206 and 207 are etched by an etching pattern to alternately form holes 208, and each of the holes 208 may be formed to be positioned to face a convex portion 209 of the uneven structure of the vibration membrane 204, e.g., at a vertically same position. Conversely, the fixed membranes 206 and 207 may be formed to be positioned to face a concave portion of the uneven structure of the vibration membrane 204, i.e., at a vertically same position. As such, since the holes 208 of the fixed membranes 206 and 207 are positioned at a same position as the convex portion of the uneven structure of the vibration membrane 204, a change in capacitance between the vibration membranes and the fixed membrane may be maximized to improve sensitivity.

In addition, the MEMS microphone includes an electrode pad 211 for applying a voltage to the fixed membrane electrode layer 206 and an electrode pad 212 for applying a voltage to the vibration membrane 204.

The electrode pad 211 may be formed by etching the fixed membrane support layer 207 to expose the fixed membrane electrode layer 206 and depositing a metal material in a thus-formed electrode hole to have a predetermined thickness. The electrode pad 212 may be formed by etching the fixed membranes 206 and 207 and the sacrificial layer 205 to expose the vibration membrane 204 and depositing a metal material in a thus-formed electrode hole to have a predetermined thickness.

In this case, the substrate 201, the fixed membrane electrode layer 206, and the vibration membrane 204 may be formed of polysilicon, the sacrificial layer 205 may be deposited as an oxide membrane, and the fixed membrane support layer 207 may be formed of a silicon nitride (SiN) layer.

Referring to the top plan view of the fixed membrane of FIG. 3, etching pattern for forming the holes 208 between the fixed membrane support layer 207 and the fixed membrane electrode layer 206 is formed to have an annular structure in a direction increasing from a center thereof to the outside, and the respective annular etching patterns are separately formed in a direction in which a constant horizontal bar pattern draws a circle at a predetermined interval.

As illustrated in FIG. 4, the vibration membrane 204 is formed in a direction in which annular patterns 213, 214, 215, and 216 of the vibration membrane 204 increase in size from a center of a corresponding circle to the outside, and the respective annular patterns 213, 214, 215, and 216 are separately formed in a direction in which a constant horizontal bar pattern draws a circle at a predetermined interval.

As such, according to the present disclosure, the vibration membrane may be formed in the uneven structure to relieve residual stress so as to reduce stiffness, and the change in capacitance between the vibration membrane and the fixed membrane may be maximized by forming a hole in the fixed membrane in a position that corresponds to the convex portion of the uneven structure of the vibration membrane, thereby improving sensitivity.

Figure 5A:
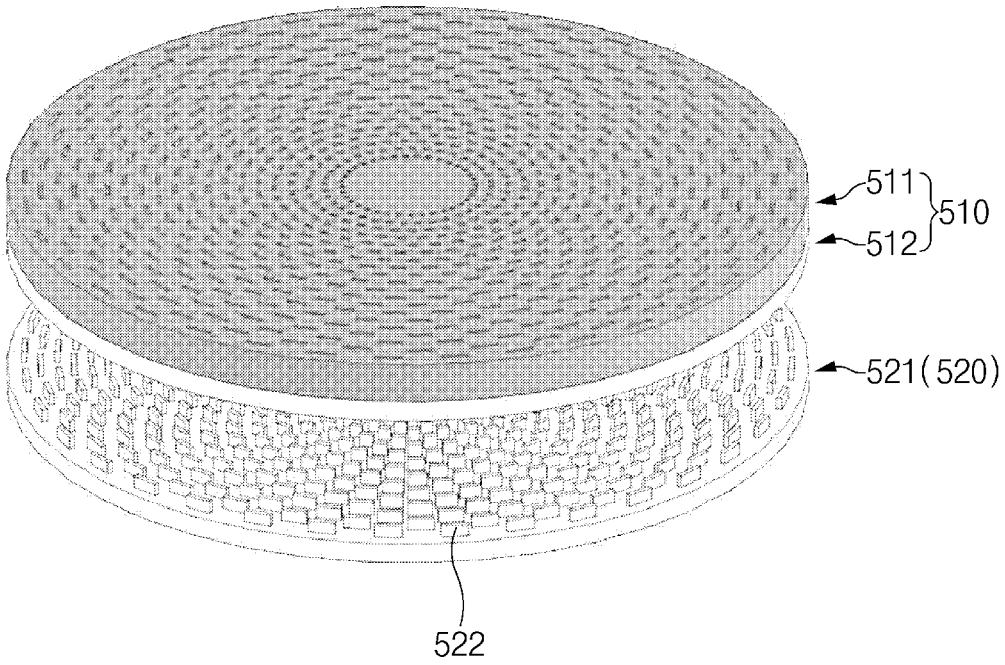
FIG. 5A to FIG. 5C illustrate 3D structural views of a MEMS microphone in one form of the present disclosure.
Figure 5B:
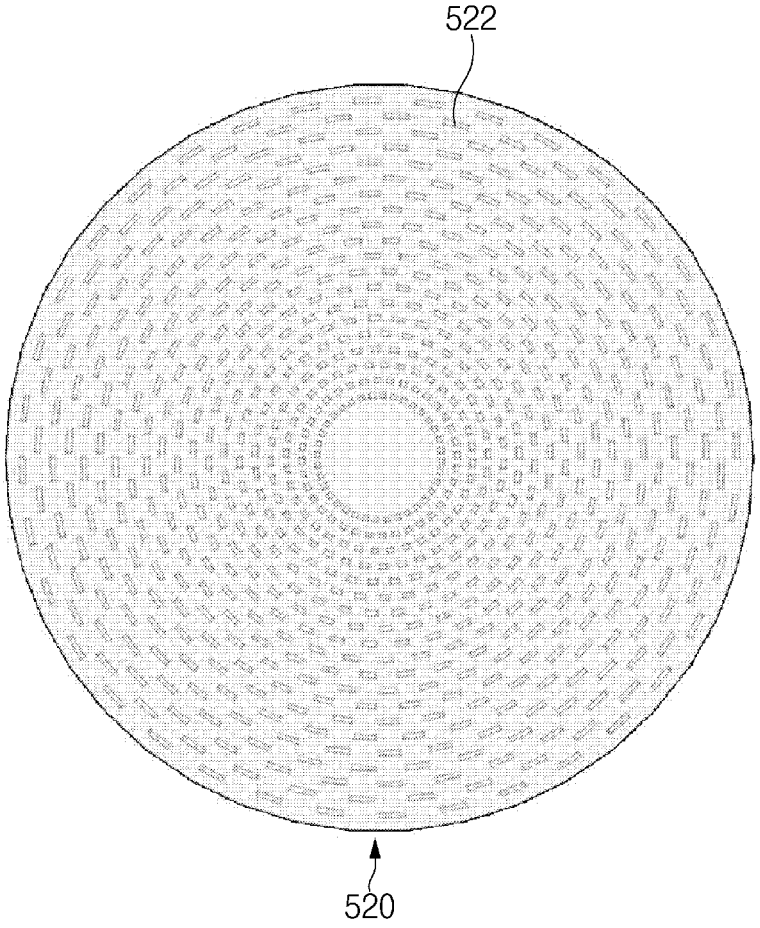
Figure 5C:
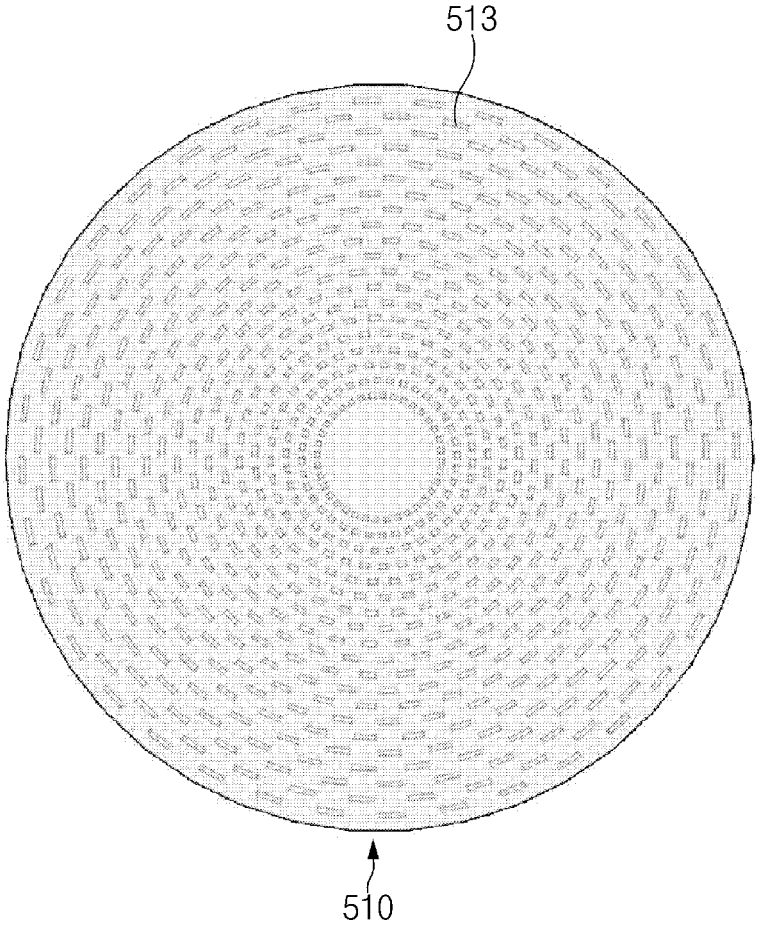

FIG. 5A to FIG. 5C illustrate 3D structural views of a MEMS microphone according to an exemplary embodiment of the present disclosure.

FIG. 5A illustrates a 3D thin-film structure of a MEMS microphone, which is configured to include a fixed membrane 510 and a vibration membrane 520, the vibration membrane 520 is configured in a form of a single polysilicon membrane 521 having an uneven structure 522 constituting an electrode layer, and the fixed membrane 510 is formed to include a fixed membrane electrode layer 511 and a fixed membrane support layer 512. In this case, the fixed membrane electrode layer 511 may be formed of a polysilicon thin film, and the fixed membrane support layer 512 may be formed of a silicon nitride layer. The vibration membrane 520 has a structure in which a slit-shaped uneven structure forms a radial shape, and a surface of the uneven structure that is perpendicular to a protruding surface thereof and contacts the fixed membrane electrode layer 511 is etched and penetrated.

FIG. 5B illustrates a plan view of the vibration membrane 520 according to an exemplary embodiment of the present disclosure, and FIG. 5C illustrates a plan view of the fixed membrane 510 according to an embodiment of the present disclosure. In the fixed membrane 510, holes 513 are alternately positioned.

FIG. 6A to FIG. 6I illustrate schematic process views for describing a manufacturing process of a MEMS microphone according to an exemplary embodiment of the present disclosure.

Figure 6A:
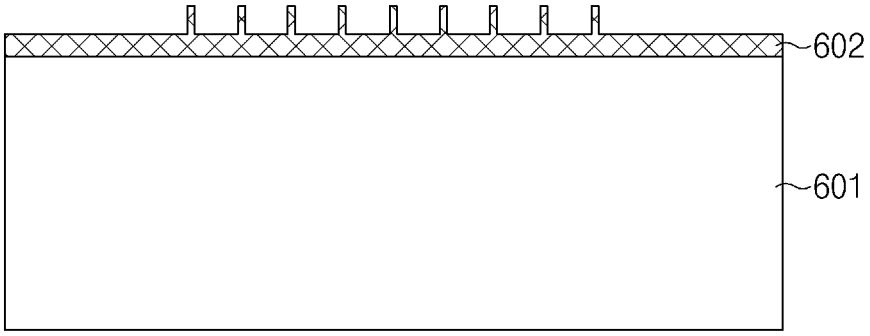
FIG. 6A to FIG. 6I illustrate schematic process views for describing a manufacturing process of a MEMS microphone in one form of the present disclosure.

First, referring to FIG. 6A, an oxide membrane 602 is deposited on a silicon substrate 601 to have a predetermined thickness, and is patterned to have an uneven shape. For example, patterning in the uneven shape may be performed using an etching mask.

Figure 6B:
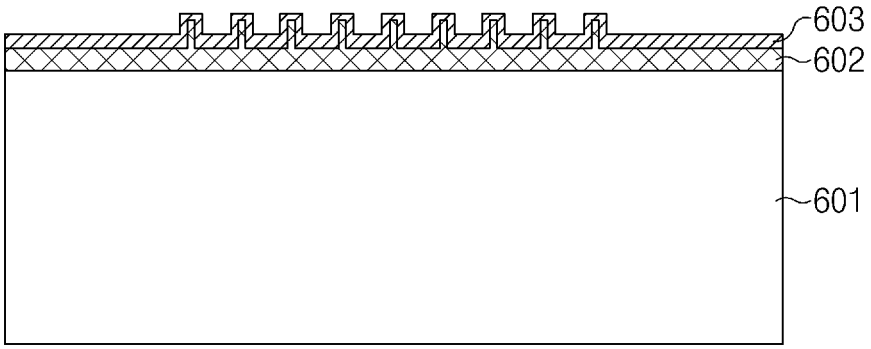

Next, referring to FIG. 6B, a vibration membrane 603 is deposited on the uneven oxide membrane 602, and ion implantation and annealing are performed thereon. For example, the vibration membrane 603 may be formed of poly-si. In this case, impurities are doped through the ion implantation, and the annealing is one of the heat treatment methods for heating a metal material, which can lower hardness and stiffness of a metal.

Figure 6C:
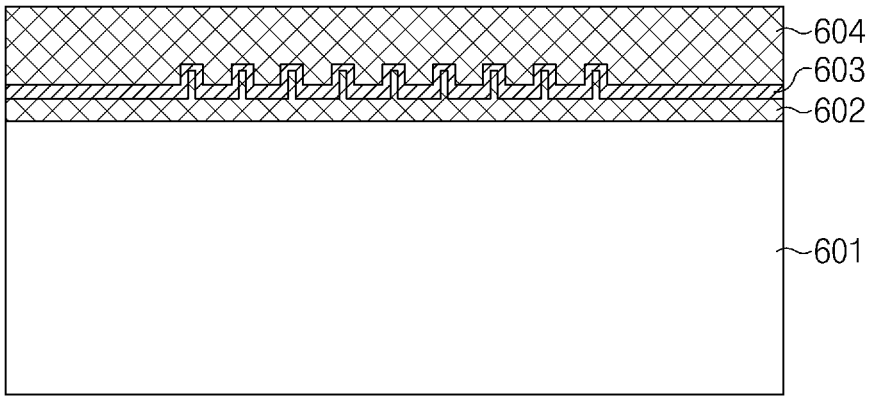

Next, referring to FIG. 6C, an oxide membrane for forming a sacrificial layer 604 is deposited on the annealed vibration membrane 603 to have a predetermined thickness.

Figure 6D:
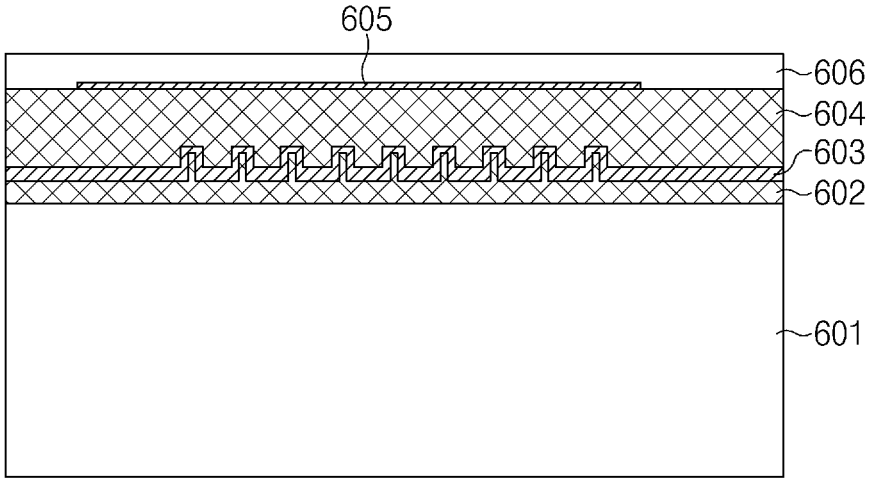

Next, referring to FIG. 6D, a fixed membrane electrode layer 605 is deposited on the sacrificial layer 604, ion implantation and annealing are performed thereon, and then a silicon nitride membrane (SiN) for forming a fixed membrane support layer 606 is deposited thereon to have a predetermined thickness. For example, the fixed membrane electrode layer 605 may be formed of polysilicon.

Figure 6E:
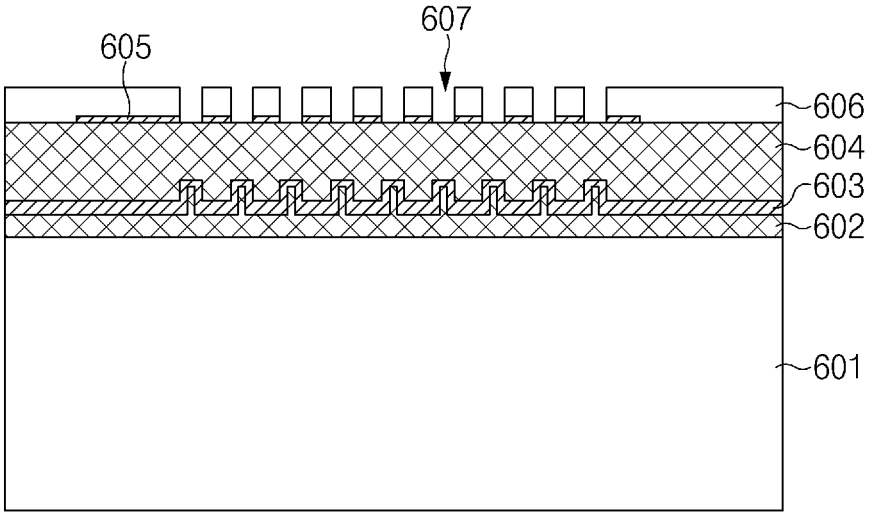
Figure 6F:
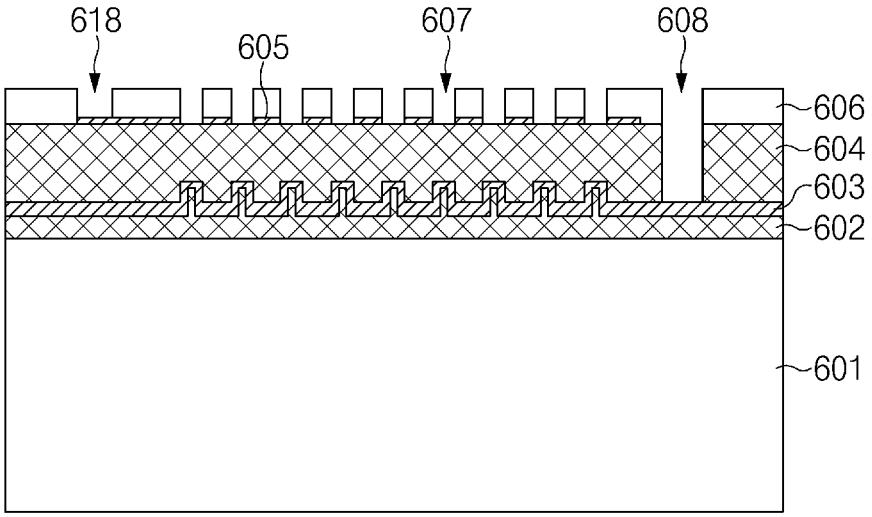

Next, referring to FIG. 6E, patterning of a fixed hole for forming the fixed membrane electrode layer 605 in an uneven type is performed. For example, the fixed membrane electrode layer 605 may be formed to have an uneven structure by forming a fixing hole 607 by etching the fixed electrode layer 605 using an etching mask Next, referring to FIG. 6F, holes 608 and 618 for forming an electrode pad is formed by etching the sacrificial layer 604, the fixed membrane electrode layer 605, and the fixed membrane support layer 606 on the vibration film 603 through an etching process.

Figure 6G:
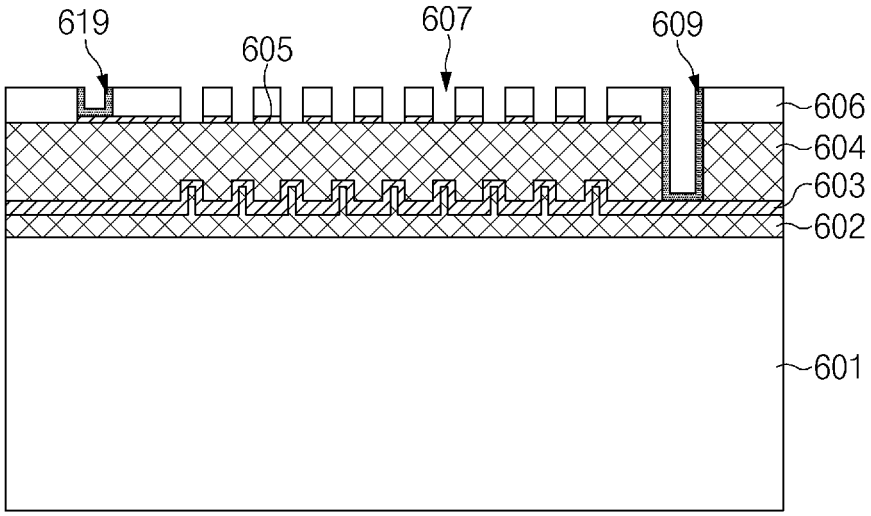

Next, referring to FIG. 6G, electrode pads 609 and 619 are formed by depositing a metal material for forming an electrode pad on the electrode pad hole 608.

Figure 6H:
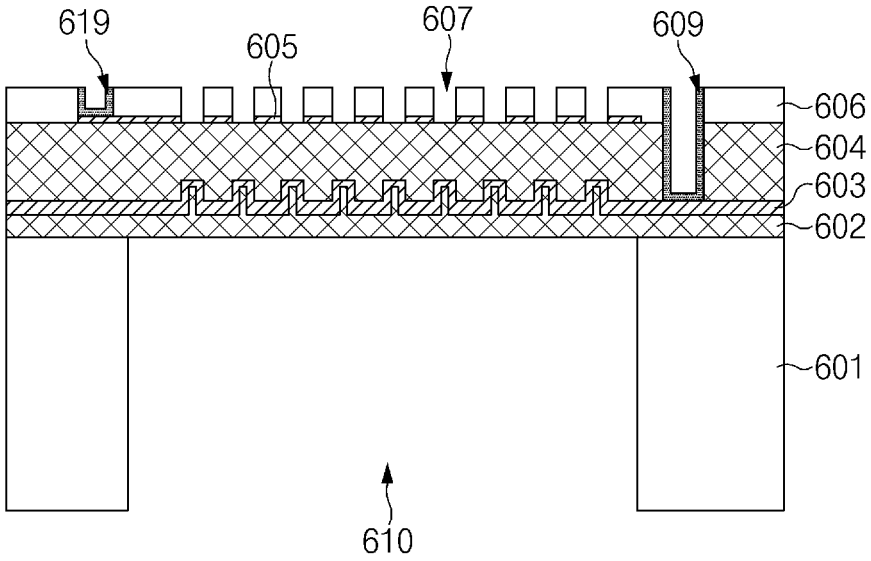

Next, referring to FIG. 6H, a through portion 610 is formed by etching the silicon substrate 601 to a position where the oxide membrane 602 is exposed through back etching of the silicon substrate 601 under the vibration membrane 603.

Figure 6I:
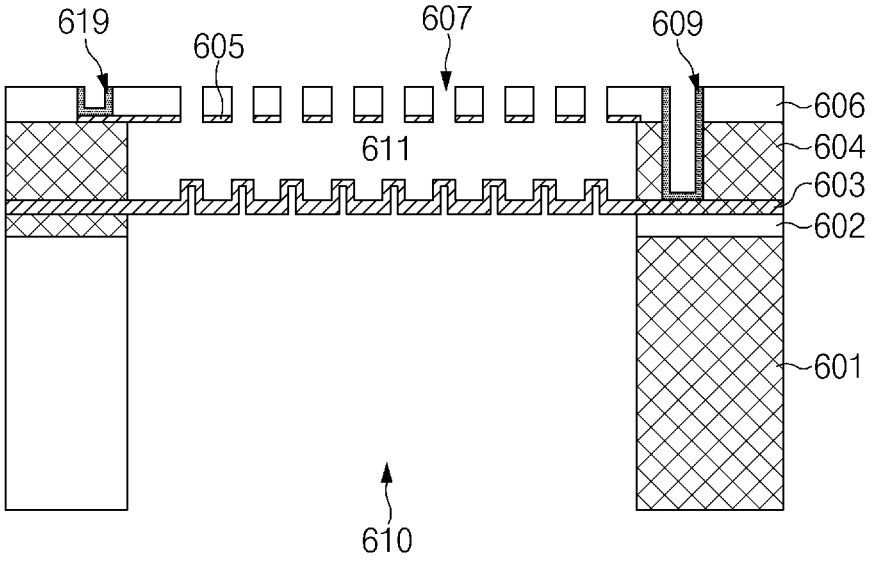

Next, referring to FIG. 6I, the oxide membrane 602 and the sacrificial layer 604 are etched through hydrofluoric acid evaporation etching, and an air layer 611 is formed by etching it to a position where the fixed membrane electrode layer 605 is exposed. Accordingly, the vibration membrane 603 and the fixed membrane electrode layer 605 are spaced apart by a predetermined interval by the air layer 611.

Figure 7A:
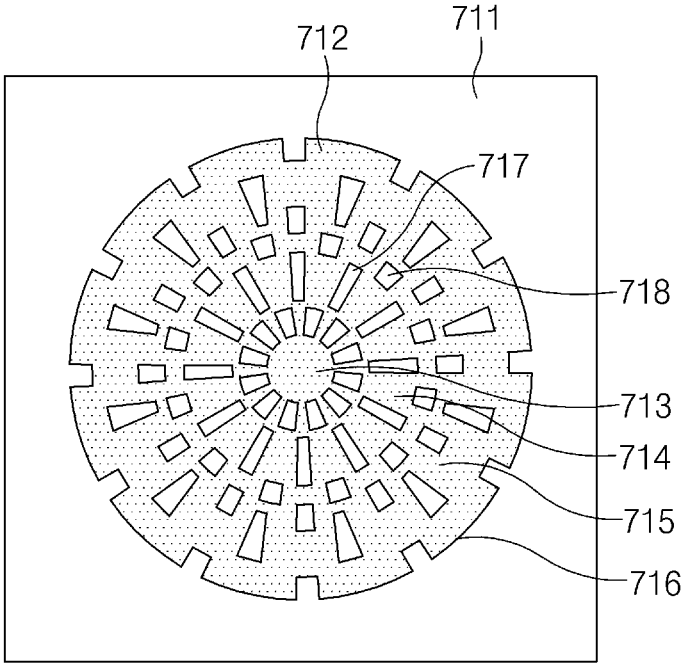
FIG. 7A and FIG. 7B illustrate a top plan view of a vibration membrane of a MEMS microphone in one form of the present disclosure.
Figure 7B:
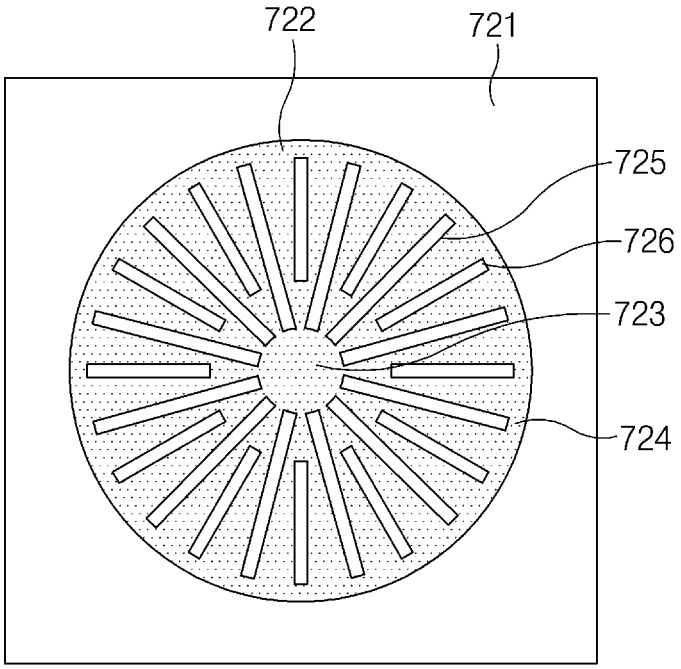

FIG. 7A and FIG. 7B illustrate a top plan view of a vibration membrane of a MEMS microphone according to another exemplary embodiment of the present disclosure.

Referring to FIG. 7A, a vibration membrane 711 having an uneven structure has an etching pattern 712 having an annular structure, and includes annular structures 714, 715, and 716 gradually expanding around a central circle 713.

Each of the annular structures 714, 715, and 716 outwardly expands from the central circle 713, includes patterns 717 and 718 which are alternately positioned, and each of the patterns 717 and 718 has a different length that is outwardly extending from the central circle 713. In FIG. 7A, the pattern 717 may be formed to be longer than the pattern 718.

Referring to FIG. 7B, the vibration membrane 721 has an etching pattern 722 having an annular structure, patterns 725 and 726 extending from a center 723 to an outer circumference 724 are alternately positioned in a clockwise direction, each of the pattern 725 and the pattern 726 include a longitudinal shape extending from the center 723 to the outer circumference 724, and a length of the pattern 725 may be longer than that of the pattern 726.

Figure 8:
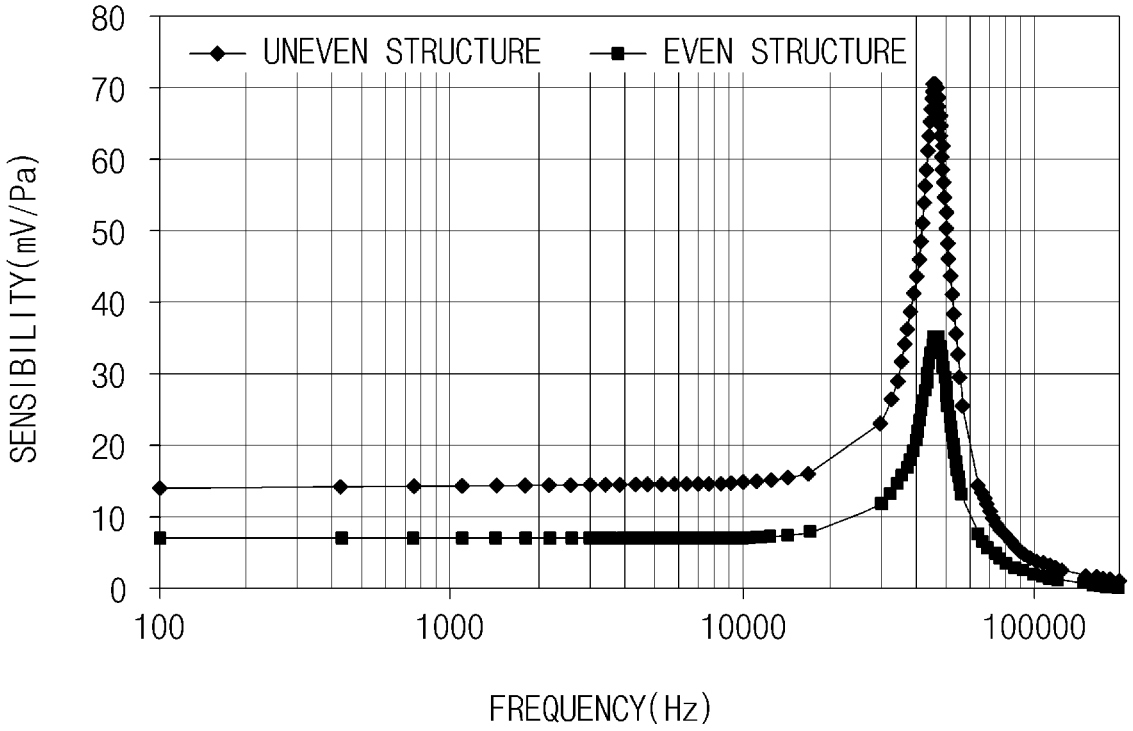
FIG. 8 illustrates a graph showing a comparison of sensitivity of an uneven structure and an even structure of a vibration membrane of a MEMS microphone in one form of the present disclosure.
Figure 9:
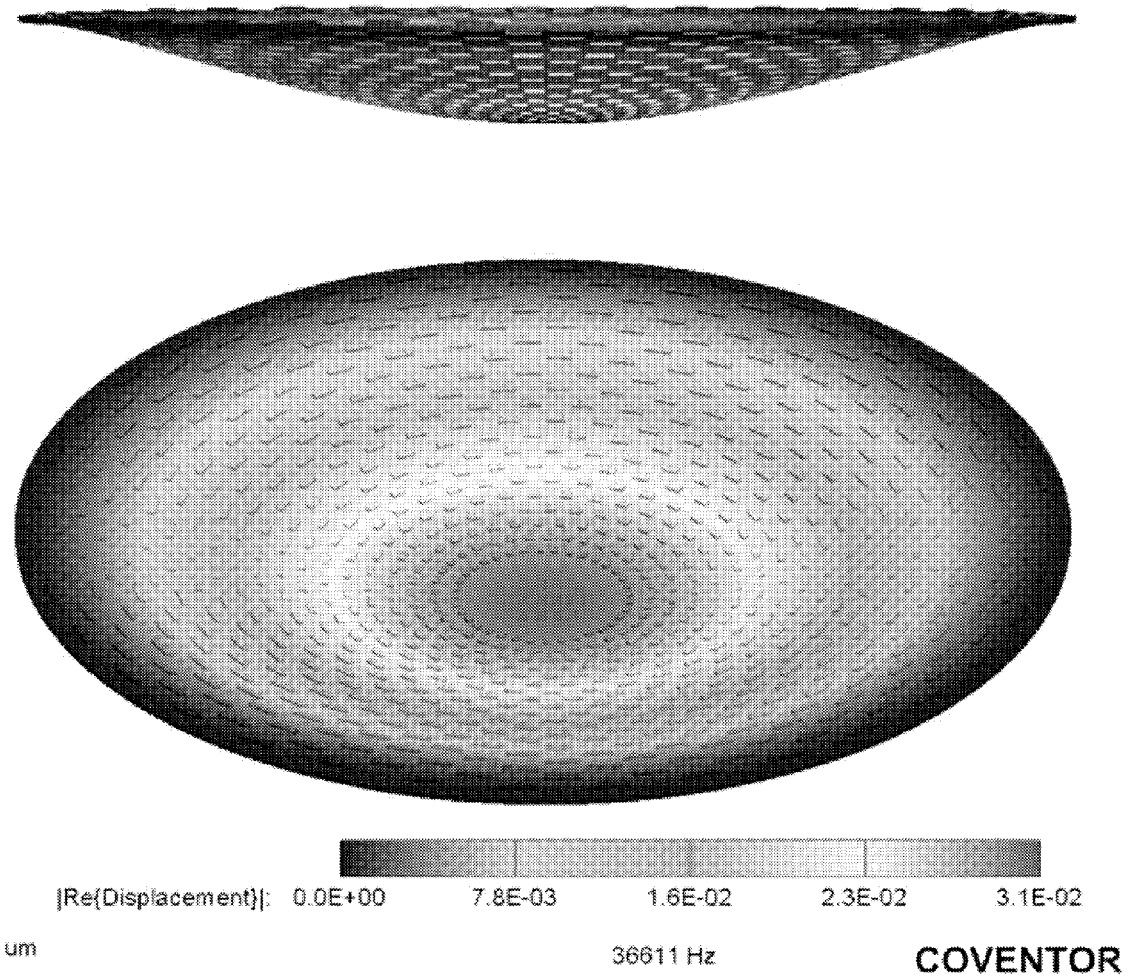
FIG. 9 illustrates a displacement analysis result of a vibration membrane having an uneven structure in a MEMS microphone in one form of the present disclosure.

FIG. 8 illustrates a graph showing a comparison of sensitivity of an uneven structure and an even structure of a vibration membrane of a MEMS microphone according to an exemplary embodiment of the present disclosure, and FIG. 9 illustrates a displacement analysis result of a vibration membrane having an uneven structure in a MEMS microphone according to an exemplary embodiment of the present disclosure.

According to the exemplary embodiments of the present disclosure, the structures of the vibration membrane and the fixed membrane may significantly improve sensitivity without increasing a process cost by applying a relatively simple etching process to the vibration membrane.

Referring to FIG. 8, in the case of using a vibration membrane having an uneven structure, it can be seen that the sensitivity is increased by about two times compared to a microphone using a vibration membrane having an even structure.

According to the exemplary embodiments of the present disclosure, the vibration membrane of the uneven structure may be verified through analysis after 3D modeling as illustrated in FIG. 5A, and as results of analyzing the displacement and sensitivity of the vibration membrane having the uneven structure as illustrated in FIG. 9, it can be seen that the sensitivity is improved by enhancing vibration displacement and sensitivity through a decrease in the stress of the vibration membrane and by increasing the change in capacitance by the uneven structure.

The above description is merely illustrative of the technical idea of the present disclosure, and those skilled in the art to which the present disclosure pertains may make various modifications and variations without departing from the essential characteristics of the present disclosure.

Therefore, the exemplary embodiments disclosed in the present disclosure are not intended to limit the technical ideas of the present disclosure, but to explain them, and the scope of the technical ideas of the present disclosure is not limited by these exemplary embodiments. The protection range of the present disclosure should be interpreted by the claims below, and all technical ideas within the equivalent range should be interpreted as being included in the scope of the present disclosure.

What is claimed is:

1. A MEMS microphone comprising:

a substrate configured to have a through portion formed in a central portion of the substrate;

a vibration membrane configured to have an uneven structure formed on the through portion of the substrate; and a fixed membrane provided on an upper position spaced apart from the vibration membrane by a predetermined distance, wherein the vibration membrane has a plurality of annular etching patterns, and wherein the plurality of annular etching patterns is formed in a direction expanding from a center of a circle to an outer direction of the circle.

2. The MEMS microphone of claim 1, wherein the fixed membrane has an air inlet with a surface vertically facing a convex portion of the uneven structure to be penetrated.

3. The MEMS microphone of claim 1, wherein the fixed membrane is provided on the vibration membrane to be spaced apart from the uneven structure, wherein the fixed membrane further comprises:

a fixed membrane electrode layer; and a fixed membrane support layer provided on the fixed membrane electrode layer.

4. The MEMS microphone of claim 3, further comprising:

an oxide membrane provided on the substrate in a region excluding the through portion of the substrate.

5. The MEMS microphone of claim 4, further comprising:

a sacrificial layer provided on the vibration membrane that is provided on the oxide membrane.

6. The MEMS microphone of claim 5, wherein the fixed membrane support layer is provided on the sacrificial layer.

7. The MEMS microphone of claim 6, further comprising:

a first electrode pad configured to supply a voltage to the vibration membrane.

8. The MEMS microphone of claim 7, wherein the first electrode pad contacts the vibration membrane through holes that are formed by etching the sacrificial layer and the fixed membrane support layer.

9. The MEMS microphone of claim 6, further comprising:

a second electrode pad configured to supply a voltage to the fixed membrane.

10. The MEMS microphone of claim 9, wherein the second electrode pad contacts the fixed membrane through a hole that is formed by etching the sacrificial layer.

11. The MEMS microphone of claim 1, wherein each annular etching pattern has a structure in which patterns having a predetermined size are spaced apart at a regular interval in a horizontal direction to be arranged in an annular structure.

12. The MEMS microphone of claim 1, wherein the vibration membrane has an annular etching pattern, wherein the vibration membrane includes a structure in which a first pattern and a second pattern having different lengths that externally extend in a longitudinal direction from a center of a circle in the annular etching pattern are alternately arranged.

13. The MEMS microphone of claim 1, wherein each annular etching pattern includes a structure in which a first pattern and a second pattern having different lengths are alternately disposed in a longitudinal direction.

14. A manufacturing method of a MEMS microphone, the method comprising:

providing an oxide membrane on a substrate and patterning the oxide membrane to have an uneven structure;

providing a vibration membrane on the oxide membrane;

providing a sacrificial layer on the vibration membrane;

providing a fixed membrane on the sacrificial layer;

etching the fixed membrane to form alternating holes therein;

forming a through portion by etching a central portion of the substrate to expose the oxide membrane; and etching the sacrificial layer and the oxide membrane on the through portion, wherein the vibration membrane has a plurality of annular etching patterns, and wherein the plurality of annular etching patterns is formed in a direction expanding from a center of a circle to an outer direction of the circle.

15. The manufacturing method of claim 14, wherein providing the fixed membrane includes:

providing a fixed membrane electrode layer on the sacrificial layer; and providing a fixed membrane support layer on the fixed membrane electrode layer.

16. The manufacturing method of claim 14, wherein the etching of the fixed membrane includes:

etching the fixed membrane such that the holes and a convex portion of the uneven structure of the vibration membrane therebelow are positioned at a vertically same position.

17. The manufacturing method of claim 14, further comprising:

forming a first electrode pad that is connected to the vibration membrane; and forming a second electrode pad that is connected to the fixed membrane.

18. The manufacturing method of claim 17, wherein the forming of the first electrode pad includes:

forming an electrode hole by etching the fixed membrane and the sacrificial layer to expose the vibration membrane; and forming the first electrode pad by providing a metal material in the electrode hole.

19. The manufacturing method of claim 17, wherein the forming of the second electrode pad includes:

forming an electrode hole by etching the fixed membrane support layer to expose the fixed membrane electrode layer; and forming the second electrode pad by providing a metal material in the electrode hole.

20. The manufacturing method of claim 14, wherein providing the vibration membrane on the oxide membrane includes:

providing a vibration membrane on the oxide membrane;

performing ion implantation into the vibration membrane; and performing annealing on the ion-implanted vibration membrane.

* * * * *